US008978655B2

(12) United States Patent
Duke et al.

(10) Patent No.: US 8,978,655 B2
(45) Date of Patent: Mar. 17, 2015

(54) INTEGRAL VALVE EFFECT RESPIRATOR

(76) Inventors: John Hincks Duke, Providence, RI (US); Ritu Goel, Lincoln, RI (US)

( * ) Notice: Subject to any disclaimer, the term of this patent is extended or adjusted under 35 U.S.C. 154(b) by 210 days.

(21) Appl. No.: 13/547,004

(22) Filed: Jul. 11, 2012

(65) Prior Publication Data

US 2012/0279507 A1 Nov. 8, 2012

Related U.S. Application Data

(63) Continuation-in-part of application No. 12/359,414, filed on Jan. 26, 2009, now abandoned.

(60) Provisional application No. 61/023,246, filed on Jan. 24, 2008.

(51) Int. Cl.

| | |
|---|---|
| ***A62B 18/08*** | (2006.01) |
| ***A62B 19/00*** | (2006.01) |
| ***A62B 7/10*** | (2006.01) |
| ***A62B 18/02*** | (2006.01) |
| ***A62B 23/02*** | (2006.01) |

(52) U.S. Cl.

CPC ..... *A62B 23/025* (2013.01)
USPC ..... 128/206.12; 128/206.15; 128/206.19

(58) Field of Classification Search

USPC ..... 128/206.11–206.19, 200.24, 207.11, 128/206.27, DIG. 26, DIG. 15, 207.17, 876
See application file for complete search history.

(56) References Cited

U.S. PATENT DOCUMENTS

| | | | | | |
|---|---|---|---|---|---|
| 1,319,273 | A * | 10/1919 | Hello | 128/206.16 |
| 2,070,754 | A * | 2/1937 | Schwartz | 128/206.12 |
| 4,319,567 | A * | 3/1982 | Magidson | 128/206.19 |
| 4,616,647 | A * | 10/1986 | McCreadie | 128/206.19 |
| 5,596,985 | A * | 1/1997 | Collier | 128/206.19 |
| 6,386,198 | B1 * | 5/2002 | Rugless | 128/206.21 |
| 7,836,887 | B1 * | 11/2010 | Kling | 128/206.16 |
| 2003/0221690 | A1 * | 12/2003 | Lee | 128/206.12 |
| 2007/0068529 | A1 * | 3/2007 | Kalatoor et al. | 128/206.19 |
| 2009/0199856 | A1 * | 8/2009 | Berlin | 128/206.13 |

* cited by examiner

*Primary Examiner* — Lynne Anderson
*Assistant Examiner* — Bradley Philips
(74) *Attorney, Agent, or Firm* — Barlow, Josephs & Holmes, Ltd.

(57) ABSTRACT

A respirator comprises: a nose and mouth covering porous filter body and a flexible restraining device arranged so that the body may pivot in its vertical plane of symmetry about its nose contact portion, and the restraining device attaches to the body at positions where its restraining force imparts torque in the body about said nose contact portion so that the chin contact portion of said body bears against the user's chin. In use, the resulting chin contact force may be less than the opposing user expiration force on the filter body, so the periphery of the chin contact portion may separate from the user's chin during expiration to benefit user comfort and mitigate eyeglass condensation.

2 Claims, 1 Drawing Sheet

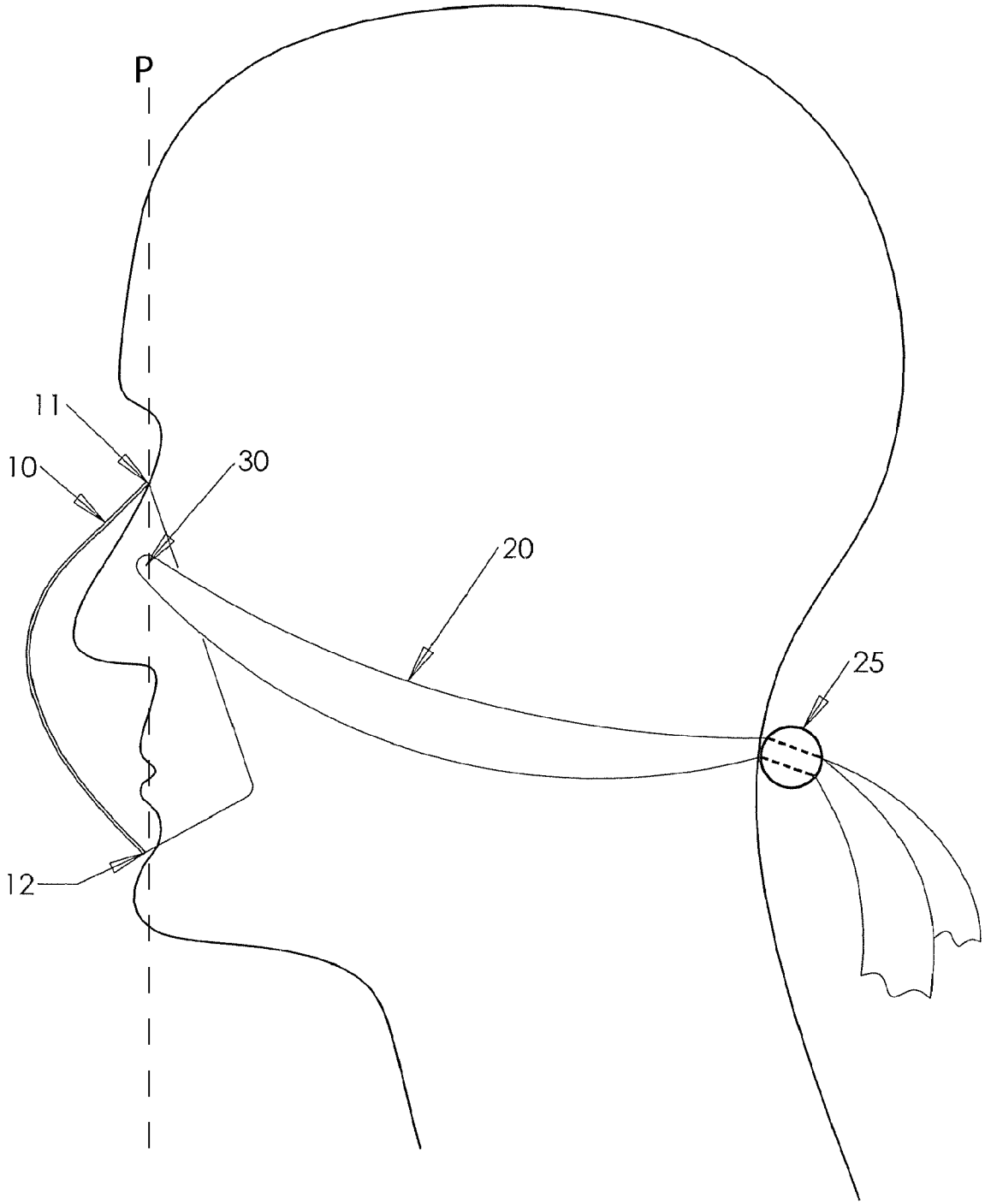
P
11
10
30
20
25
12

INTEGRAL VALVE EFFECT RESPIRATOR

RELATED APPLICATION

This application is a continuation in part of U.S. patent application Ser. No. 12,359,414 filed Jan. 26, 2009. Application Ser. No. 12,359,414 is based upon and claims priority from U.S. Provisional Application Ser. No. 61/023,246 filed Jan. 24, 2008.

FIELD

The disclosure relates to respirators, and more particularly to an integral valve effect respirator.

BACKGROUND OF THE DISCLOSURE

For individuals that are sensitive to airborne allergens, the severity of an allergic response is often not linearly proportional to the concentration of allergens in the air they breathe. Often there is little or no response unless exposure exceeds the particular threshold concentration that triggers a cascading symptomatic reaction. To prevent onset of such symptoms, it is therefore only necessary to limit exposure to some concentration below that threshold. Presently available personal respirators vary in both filtration efficiency and degree of user comfort, and these qualities are generally inversely proportional to each other.

Presently available personal respirators also commonly incorporate a one-way valve feature that allows free expiration, to reduce required breathing effort and to minimize inspiration of previously expired carbon dioxide. Such valve features add weight, bulk, and cost.

SUMMARY OF THE DISCLOSURE

A first objective is to provide a personal respirator with filtration efficiency sufficient only to maintain allergen exposure below an allergic reaction threshold. For users of a personal respirator a particular cause of discomfort is tension created by its holding strap and the resultant pressure of the mask edge on the user's face. A second objective is therefore to minimize these particular discomforts. A third objective is to provide a personal respirator whose entire body can efficiently function as a one-way valve, so that during expiration air can pass between the periphery of the mask and the user's face. A last objective is to mitigate eyeglass fogging by directing such peripheral expiration flow downwards.

This respirator is an adjunct for the management of allergies that can complement oral medications and immunotherapy. It provides an alternative to avoidance. It will serve a great need for people with allergies and/or asthma, people living in environments with heavy pollution, and those who frequently travel by commercial aircraft. It is a device that is beneficial to a user's overall health.

In an embodiment the respirator comprises a nose and mouth covering porous filter body and a flexible restraining device arranged so that the body may pivot in its vertical plane of symmetry about its nose contact portion, and the restraining device attaches to the body at positions where its restraining force imparts torque in the body about said nose contact portion so that the chin contact portion of said body bears against the user's chin. In use, the resulting chin contact force may be less than the opposing user expiration force on the filter body, so the periphery of the chin contact portion may separate from the user's chin during expiration to benefit user comfort and mitigate eyeglass condensation. The restraining device can be non-elastic. The restraining force of the restraining device can result from its catenary deflection by gravity. The restraining device can be user adjustable.

GENERAL DESCRIPTION OF THE DRAWING

The drawing shows one embodiment of the respirator worn by a user.

DETAILED DESCRIPTION OF THE DRAWING

Referring to the drawing, a filter mask body 10 is constructed of some material with inherent shape memory that is sufficiently porous to allow air to be drawn through the mask when inhaling, but prevent flow-through of known allergens of predetermined sizes. Mask body 10 incorporates an upper nose contact portion 11 in its vertical plane of symmetry and a lower chin contact portion 12 in its vertical plane of symmetry. A transverse contact plane P that is perpendicular to the vertical plane of symmetry contains both upper nose contact portion 11 and lower chin contact portion 12. Contact plane P intersects mask body 10 substantially interior to the periphery of mask body 10. A non-elastic holding strap 20 incorporates a rearward length adjusting means 25, a left mask connection means 30, and a right mask connection means 31 not shown. The material of holding strap 20 is sufficiently massive, exceeding approximately 1.5 grams per centimeter in length, to cause a catenary deflection by gravity into a substantially non-straight form when adjusting means 25 is user set to optimize mask body 10 fit and comfort. The positions of left mask connection means 30 and a right mask connection means 31 are approximately coincident with or interior to the intersection of contact plane P and mask body 10. A distance A not shown extends from upper nose contact portion 11 to the projection of connection means 30 and 31 on plane P and the vertical plane of symmetry. Distance A is less than or equal to approximately one fourth of the distance between upper nose contact portion 11 and lower chin contact portion 12.

In operation, the user places mask body 10 so that upper nose contact portion 11 bears on his or her nose and lower chin contact portion 12 is adjacent to his or her chin. The user adjusts the length of strap 20 so that it drapes in a catenary form between the back of his or her neck or ears and connection means 31 and 32. The weight of strap 10 in this catenary form provides a low magnitude strap tension on connection points 30 and 31. When strap 20 is so adjusted the resultant force of mask body 10 on the user's face is sufficiently low to avoid discomfort and yet positions the mask so that when the user inhales, air flows through the porous mask, and when the user exhales a portion of the air flows around the periphery of lower chin contact portion 12, as described more fully below. In the above arrangement a chin bearing force between lower chin contact portion 12 and the user's chin results from a force couple in mask body 10 substantially equal to such strap tension force times distance A. The magnitude of such chin bearing force is user adjustable to be less than user expiration force on the pores of mask body 10. Provided the inherent shape memory of mask body 10, when so adjusted the entire mask body 10 then pivots during expiration in its vertical plane of symmetry about upper nose contact portion 11, so lower chin contact portion 12 separates from the user's chin. This separation allows user breath to escape around the periphery of lower chin contact portion 12, which mitigates eyeglass fogging. During inspiration the above lower chin bearing force combines with resistance of air passage though the pores of mask body 10 to seal lower chin contact portion 12 against the user's chin.

Because certain changes can be made to the above described apparatus and methods without departing from the scope of the invention, it is intended that all matter contained in the above description or shown in the accompanying drawing shall be interpreted as illustrative and not in a limiting sense.

I claim:

1. A respirator comprising:

a nose and mouth covering porous filter body with an upper nose contact portion and a lower chin contact portion, the upper nose contact portion configured and arranged as a pivot point and including an uppermost point of the porous filter body and the lower chin contact portion being an edge of the filter body configured and arranged to be in contact with a user's chin and including a lowermost point of the porous filter body, wherein the filter body is made of a material that has inherent shape memory, and the respirator further includes a flexible, non-elastic and user adjustable restraining device, wherein a mass of the restraining device is greater than or equal to 1.5 grams per centimeter, and the porous filter body includes a vertical plane of symmetry defining a right and left side of the filter body and, perpendicular to the vertical plane of symmetry, a transverse plane containing both the uppermost and lowermost points and intersecting an interior of the filter body, and on each right and left side of the filter body, the restraining device attaches to the filter body at a position coincident with or interior to the intersection of said transverse plane with the filter body thereby securing the filter body by providing a restraining force, and a vertical distance running along said transverse plane measured between the uppermost point and the attachment positions of the restraining device is less than or equal to one fourth of a distance between the uppermost point and the lowermost point, and the attachment positions of the restraining device are such that, when draped in a non-straight form, weight and catenary deflection by gravity of the restraining device cause the restraining force to seal the lower chin contact portion during inspiration and enable user expiration force to pivot said filter body in its vertical plane of symmetry about said nose contact portion during user expiration, thereby separating the lower edge chin contact portion of the filter body from contact with the user's chin.

2. A respirator, comprising:

a porous filter body with an upper nose contact portion having an uppermost point and a lower chin contact portion being an edge of the filter body configured and arranged to be in contact with a user's chin and having a lowermost point, wherein the porous body filter has a vertical plane of symmetry and an inherent shape memory, and the respirator further comprises an attachment device that has a mass equal to or greater than 1.5 grams per centimeter and is attached near the uppermost point of the filter body such that, when draped in a non-straight form, weight and catenary deflection by gravity of the attachment device cause a restraining force that seals the lower chin contact portion during inspiration and enables user expiration force to pivot said filter body in its vertical plane of symmetry about said nose contact portion during user expiration, thereby separating the lower edge chin contact portion of the filter body from contact with the user's chin.

* * * * *